US005088221A

United States Patent [19]

Bussiere et al.

[11] Patent Number: 5,088,221

[45] Date of Patent: Feb. 18, 1992

[54] SIGN ASSEMBLY

[75] Inventors: Joseph P. Bussiere; Richard A. Bussiere; Daniel J. Bussiere; Christopher M. Lindop, all of Edmonton, Canada

[73] Assignee: Canadian Consumer Products Ltd., Nisku, Canada

[21] Appl. No.: 377,185

[22] Filed: Jul. 7, 1989

[51] Int. Cl.[5] ..... G09F 7/02

[52] U.S. Cl. ..... 40/618; 40/576; 40/611

[58] Field of Search ..... 40/618, 575, 576, 5, 40/611, 549, 572, 152

[56] References Cited

U.S. PATENT DOCUMENTS

| | | | |
|---|---|---|---|
| 709,466 | 9/1902 | Butt | 40/611 |
| 1,120,876 | 12/1914 | Witz | 40/576 |
| 1,812,979 | 7/1931 | Pasini | 40/575 X |
| 1,853,703 | 4/1932 | Send | 40/618 |
| 2,054,698 | 9/1936 | Geistert et al. | 40/611 X |
| 2,147,869 | 2/1939 | Wales | 40/611 X |
| 3,883,967 | 5/1975 | Barnes . | |
| 4,261,122 | 4/1981 | LeVine | 40/152 |
| 4,267,657 | 5/1981 | Kloke | 40/549 |
| 4,593,486 | 6/1986 | Visocky et al. | 40/490 |
| 4,682,430 | 7/1987 | Ramsay | 40/5 |
| 4,693,026 | 9/1987 | Callahan et al. | 40/576 |

*Primary Examiner*—Kenneth J. Dorner
*Assistant Examiner*—J. Bonifanti
*Attorney, Agent, or Firm*—Anthony R. Lambert

[57] ABSTRACT

The invention consists of an open enclosure with pairs of spaced and parallel horizontal channels extending between end members front and rear and having a source of illumination therein. Cartridges are slideable from one end between adjacent tracks and these cartridges carry replaceable opaque plates having transparent indicia thereon. The plates slideably engage the cartridge from the upper side of the cartridge and between spacer bars. One piece gates close off all of the tracks so that a single lock such as a padlock for the front and rear gates can lock the entire assembly against tampering or unauthorized removal of the cartridges and plates. An alternative embodiment permits loading of the cartridges from the upper longitudinal side for substantially permanent signs with limited side access and the gates are then situated along the upper edge. If ony one side of the sign is to be used, then a blank plate or panel is inserted on the other side spanning the entire rear side of the sign.

11 Claims, 9 Drawing Sheets

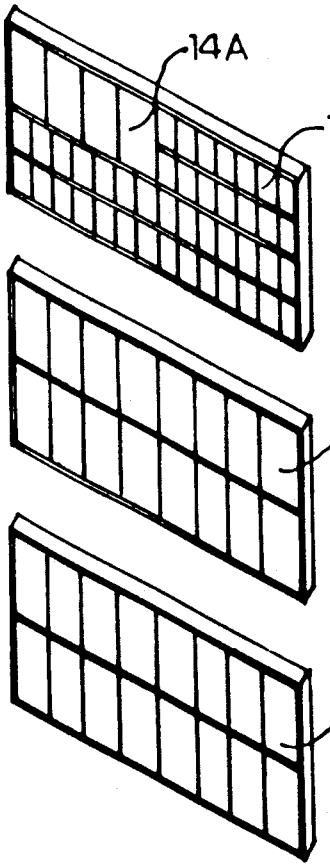
FIG. 3
FIG. 4
FIG. 5
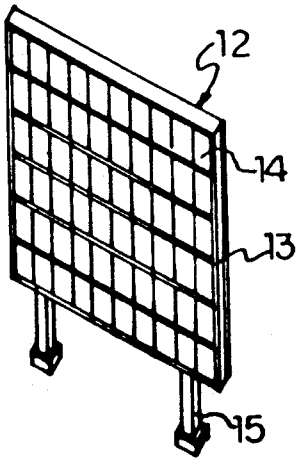
FIG. 2
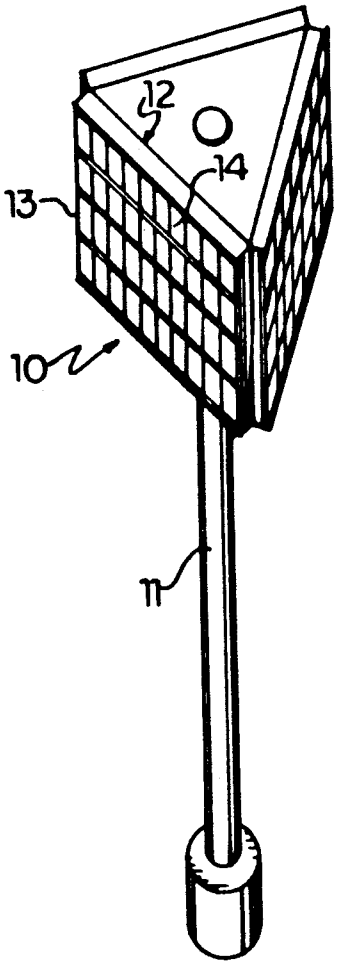
FIG. 1

SIGN ASSEMBLY

BACKGROUND OF THE INVENTION

This invention relates to new and useful improvements in sign assemblies, particularly illuminated sign assemblies whether they be permanent or temporary, or double or single sided.

Conventionally, there are two common types of signs. On most portable and read-a-board signs, a facia board is provided with tracks attached to a frame and separate individual characters either alphabetical or numerical are then slid into the tracks. If the sign is illuminated from the rear, then the entire facia board is lit up with the exception of the characters which provide a contrast to the illumination thus assisting in the readability of the letters or numbers. Such tracks are open ended so that the message can readily be tampered with, altered or stolen and message changes are of course very time consuming as all of the letters have to be removed so that the change can take place.

Secondly, on more permanents signs such as business identification signs on the front of stores, the characters, either letters or numerals, are silk screened and permanently mounted upon the facia board thus giving a combined facia and character board. However this method is totally inflexible as any change in characters or change in the information requires a total remaking of the facia board and artwork thereon which is prohibitively expensive.

PRIOR ART

U.S. Pat. No. 1120876, Dec. 15, 1914, Philip Witz. Although this shows a cartridge, the individual letters or plates are inserted from one end thereof so that if any change or correction is required, all of the letters have to be removed up to the point where the change or correction is desired. The cartridge consists of an elongated U-shaped rod with the letters having upper and lower hooked sides so that they "clench" over the two horizontal rods forming the legs of the U-shaped configuration.

U.S. Pat. No. 3883967, May 20, 1975, Guy W. Barnes. This shows a standard type sign in which the individual letters are slid individually between fixed tracks.

U.S. Pat. No. 4593486, June 10, 1986, J. E. Visocky et al. This assembly shows basically a minimum price display device in which flexible strips are fed individually over a curved backing plate.

U.S. Pat. No. 4682430, July 28, 1987, C. F. Ramsay. This shows a pressed chip support strip which requires flexible panels otherwise they will not enter or leave the strip together with various projections, lips and the like to retain the price chips in the desired location.

The present invention overcomes the negative aspects of existing signs as well as reinforcing and expanding on the positive aspects of such signs.

In accordance with the invention there is provided a sign assembly comprising in combination an enclosure, cartridge guiding and retaining track components in said enclosure and at least one elongated cartridge detachably engageable and removeable from said guides, and gate means in cooperation with said enclosure for detachably retaining said cartridges within said enclosure, each said cartridge including a pair of spaced and parallel end frame members, a longitudinally extending lower frame member and a longitudinally extending upper frame member and a plurality of vertical divider members extending between said upper and lower frame members in equal spaced and parallel relationship with said end frame members, said frame members and said dividers defining a plurality of side by side rectangular plate receiving openings, elongated slots in said upper frame member a least through the portions thereof between said vertical dividers, track means in said side and lower frame members and in said dividers, and a plurality of plates slideably engageable through said slots and into said track means, transparent indicia formed on at least some of said plates with the surrounding portions of said plates and the remainder of said plates being opaque and a source of illumination within said assembly inboard of said cartridge guiding and retaining track components.

A further aspect of the invention is to provide a cartridge for use in a sign assembly comprising in combination a pair of spaced and parallel end frame members, a longitudinally extending lower frame member, a longitudinally extending upper frame member and a plurality of vertical divider members extending between said upper and lower frame members in equal spaced and parallel relationship with said end frame members, said frame members and said dividers defining a plurality of side by side rectangular plate receiving openings, elongated slots in said upper frame members at least through the portions thereof between said vertical dividers, track means in said side and lower frame members and in said dividers and a plurality of plates slideably engageable through said slots and into said track means, transparent indicia formed on at least some of said plates with the surrounding portions of said plates and the remainder of said plates being opaque and a source of illumination within said assembly inboard of said cartridge guiding and retaining track components.

Further important aspects of the present sign assembly may include use as a single or double sided sign, illumination of the indicia upon the individual plates rather than the facia which is completely blanked out, cartridge loading in which the cartridge receives the letter or numeral plates from the upperside thereof and is then slid into the tracks thus making changing or alteration relatively simple; and locking the cartridges in place against removal, change, tampering or theft.

A further advantage of the invention is the adaptability of the structure to enable some parts of the display facia to include double sized letters or numerals at various selected locations either on the front or rear side of the enclosure.

A still further advantage of the invention is to provide a device of the character herein described which is simple in construction, economically manufactured and otherwise well suited to the purpose of which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 1 is an isometric view of an exemplary use of the existing sign system.

FIG. 2 shows an exemplary double sided sign in contrast to the single sided sign of FIG. 1.

FIGS. 3, 4 and 5 show isometric schematic views of various combinations of single and double sized indicia which may readily be provided in the sign structure.

In the drawings like characters of reference indicate corresponding parts in the different figures.

DETAILED DESCRIPTION

Figure 6:
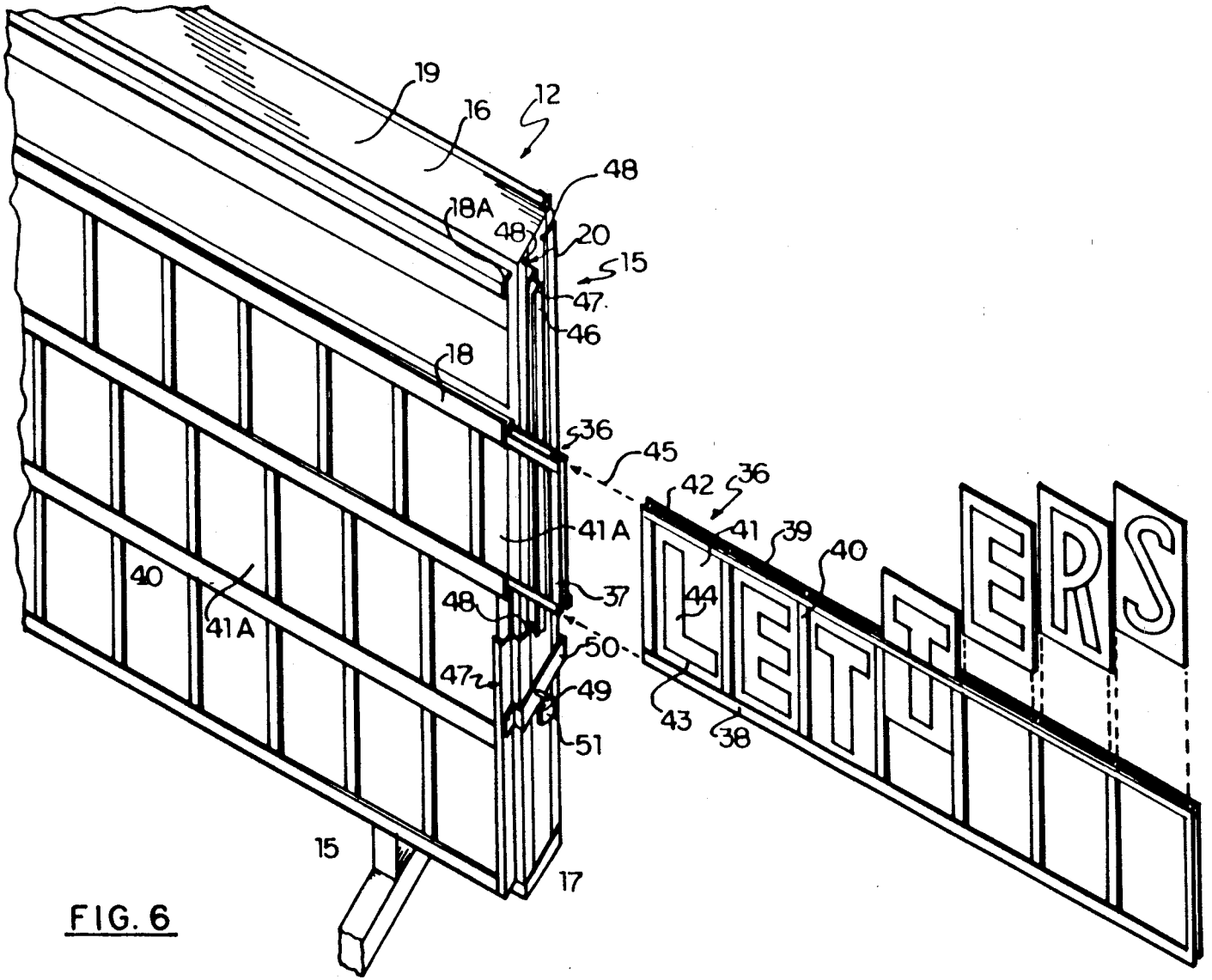
FIG. 6 is a fragmentary partially sectioned isometric view of one end of a double sided sign assembly with a portion of one of the cartridges shown removed from the guides or tracks.

Proceeding therefore to describe the invention, reference should first be made to FIGS. 1 through 5. FIG. 1 shows an example of the sign system collectively designated 10 in a triangular configuration mounted upon a standard 11 with the individual sign assemblies collectively designated 12 being utilized as one-sided signs having four rows 13 of individual panels 14 upon which alphabetic, numeric or other indicia may be provided as will hereinafter be described.

FIG. 2 shows an individual sign assembly 12 supported upon standards 15 and operated as a two-sided sign, it being understood that the messages on either side may be the same or different as desired.

FIGS. 3, 4 and 5 show in a schematic manner how the individual cells or plates 14 may be arranged in four rows of plates of similar size as shown in FIG. 1 or with some of the plates 14A being double-sized in height and width either to one end of the upper two rows as shown in FIG. 3 or the complete upper two rows as shown in FIG. 5 or all double-sized plates as shown in FIG. 4. It should be understood that the various arrangements illustrated may be the same on both sides when used as a two-sided sign as shown in FIG. 2 or may vary as desired depending upon individual design and circumstances.

In detail, reference should first be made to FIG. 6 in which there is provided a rectangular enclosure collectively designated 15 comprising an elongated upper extrusion portion 16 and a similar lower extrusion portion 17 both formed with an elongated cartridge guide and retaining track o channel 18 preferably formed on either side of the main web 19.

The vertical end walls or members 20 and 21 are joined to the upper and lower members 16 and 17 either by screws or welding (not illustrated) to form a substantially rectangular open frame with the tracks or channels 18 being situated on the side edges of the inner surface thereof as clearly shown in FIG. 6.

Figure 9:
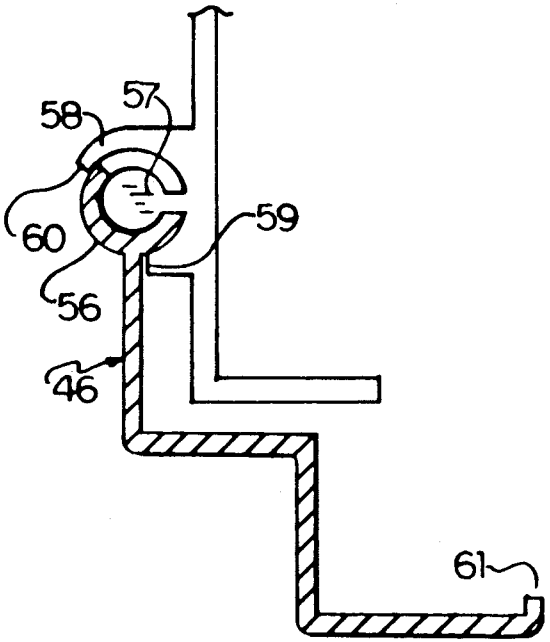
FIG. 9 is a fragmentary horizontal section showing the end walls and locking gates.
Figure 9:
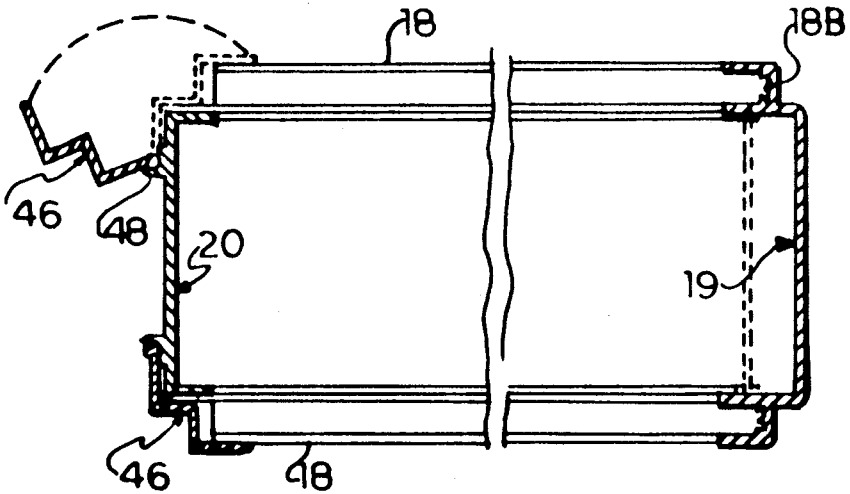
Figure 10:
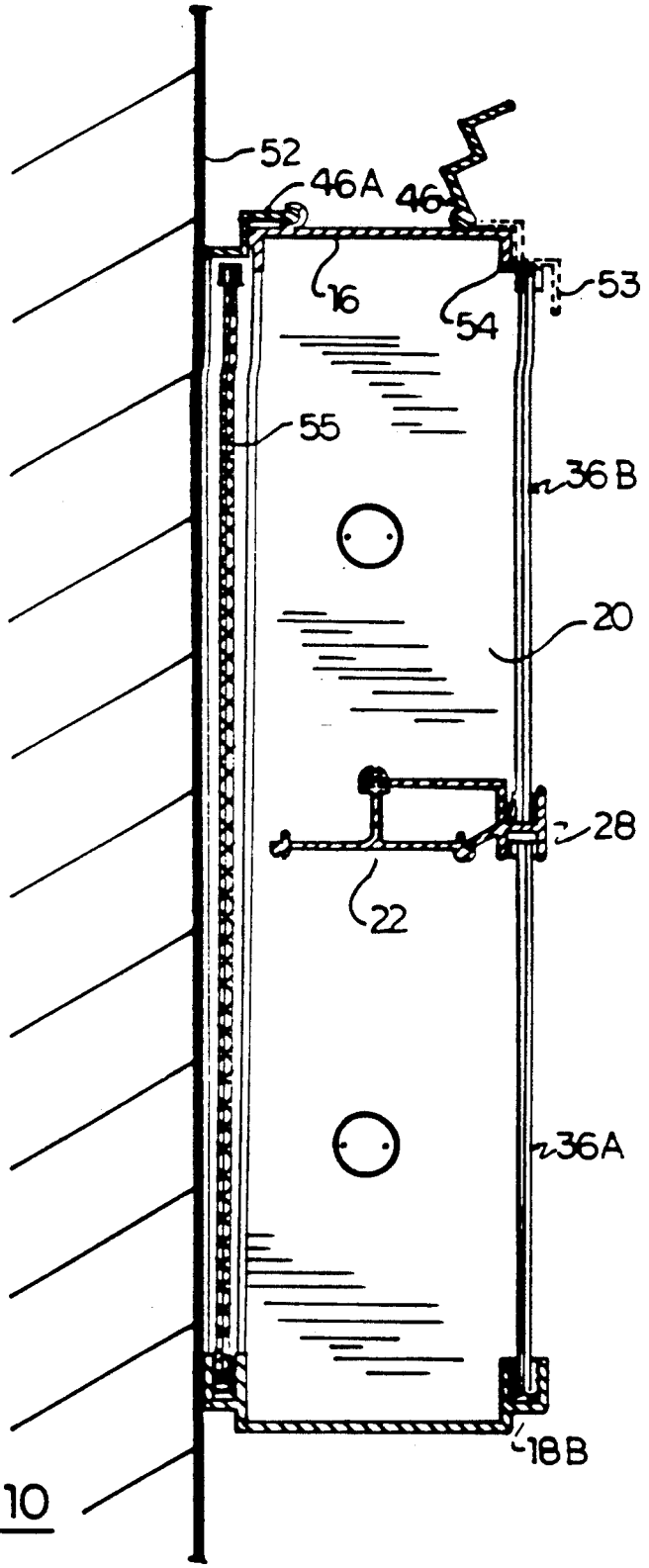
FIG. 10 is a vertical section through a sign attached to a wall an upper horizontal gates.

These tracks or channels 18 are preferably opened at one end 18A and closed at the other end 18B as shown in FIG. 9 and 10.

Figure 7:
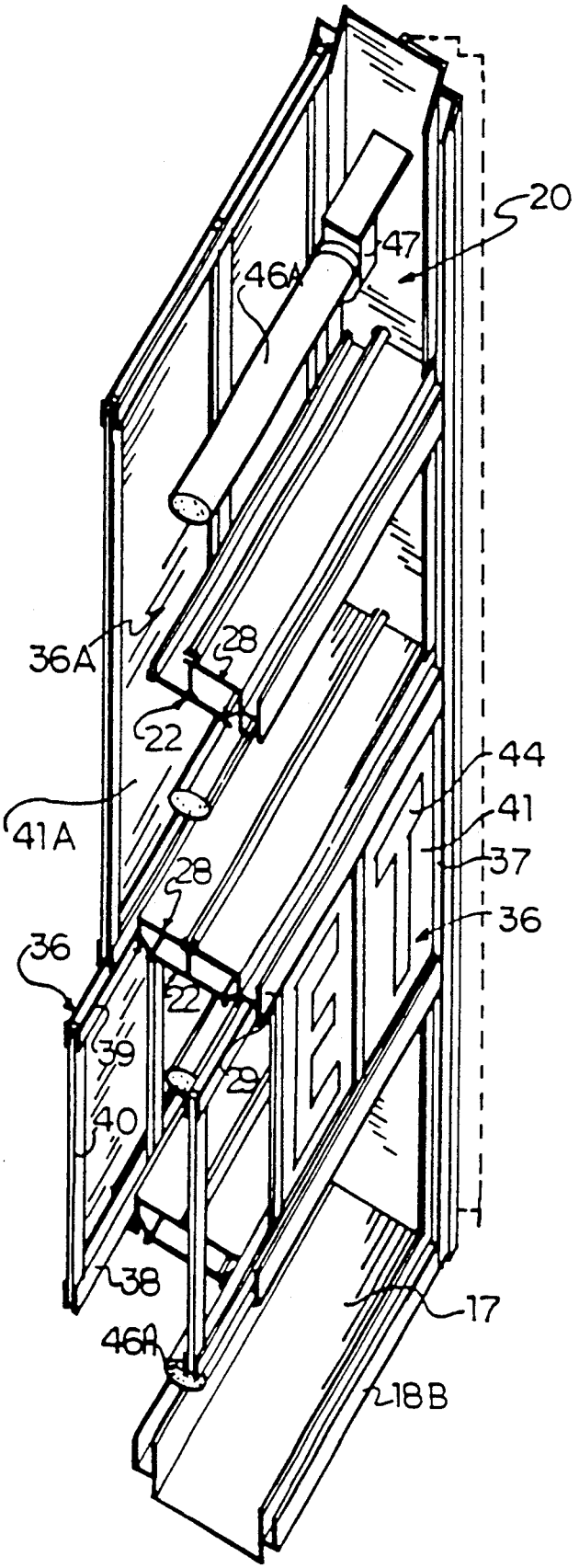
FIG. 7 is a fragmentary partially sectioned isometric view of the inside of the sign assembly.
Figure 8:
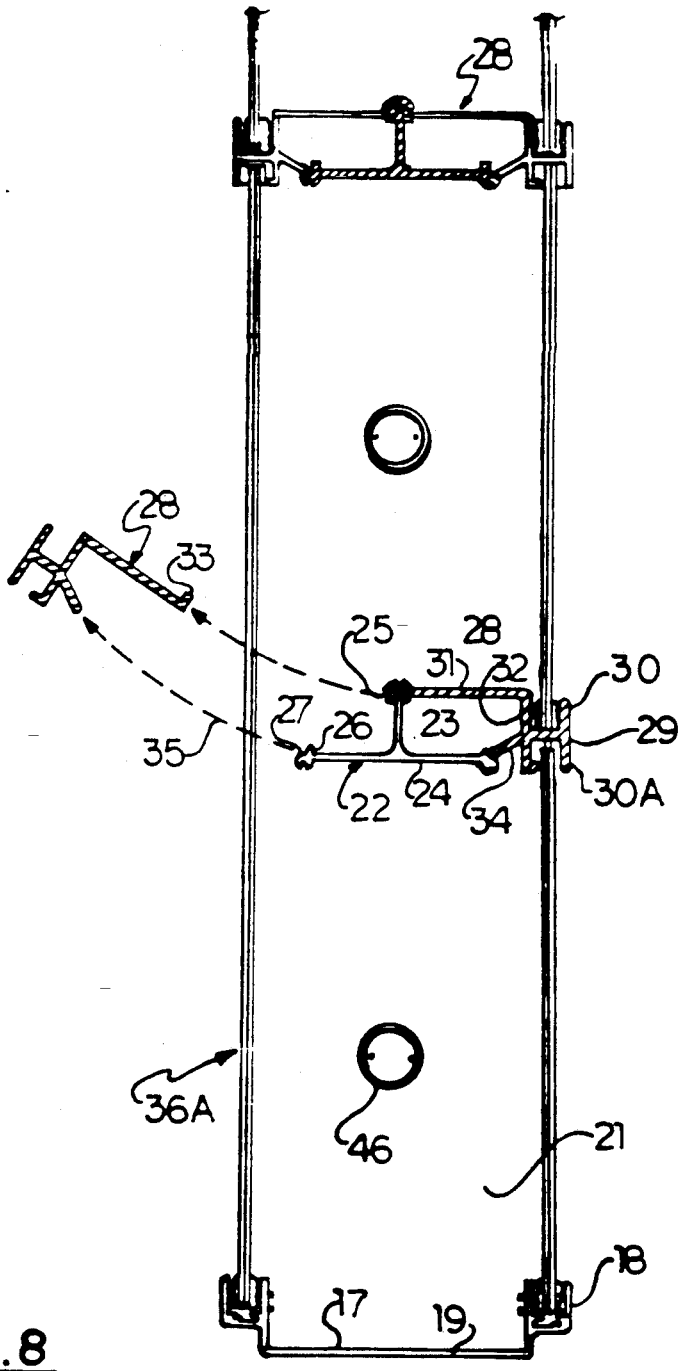
FIG. 8 is a fragmentary vertical section of FIG. 7.

In the preferred embodiment, at least one longitudinally extending cartridge guiding and retaining track support member 22 is provided which extends longitudinally between the end walls or members 20 and 21 and although one such support 22 is illustrated in FIG. 10 two or more may be provided as shown in FIGS. 6, 7 and 8 thus dividing the enclosure into four separate rows as will hereinafter be described.

The support 22 is substantially of an inverted T-shaped cross-sectional configuration and includes the vertical stem portion 23 and the cross bar portion 24. Longitudinally extending hook type grooves 25 are provided upon each side of the stem adjacent the upper end thereof and longitudinally extending beads 26 are provided just inboard of the outer ends of the cross-bar 24 to provide support angles 27 for a double-sided cartridge guiding and retaining track component collectively designated 28. This component includes the double track portion 29 which has an H-shaped cross-sectional configuration forming an upper track 30 and a lower track 30A. A longitudinally extending horizontally angled flange 31 extends inboard of the inner side 32 of the upper track 30 and terminates in a bead 33 which may be hook-engaged within the groove 25 and then lowered into position so that a longitudinally extending leg flange 34 engages the angle 27 as clearly shown in FIG. 8. This leg flange inclines inwardly and downwardly from the inner web of the H-cross section as clearly shown and supports the double track 28 horizontally as illustrated. In order to remove same, it is pivoted upwardly so that the bead 33 disengages from the hook track 25 whereupon it may be removed in the direction of arrows 35 shown in FIG. 8.

Slideably engageable between adjacent vertical pairs of tracks 18 and 28, double tracks 28 or 18A and 28 are cartridges collectively designated 36. These cartridges may be of a standard size as shown for example in FIG. 6 or may be of a double size as illustrated in FIG. 8 and designated 36A.

One of the advantages of the present invention is that the tracks can be arranged to receive standard cartridges as shown in FIG. 6 or, one of the double tracks 28 may be removed as shown in FIG. 8 so that a double sized cartridge may be utilized.

It is desirable that two adjacently located tracks 28 be used at each location so that one or the other may be removed when double sized cartridges are required. It is also desirable that two of the rectangular cartridges 36 be used in each row and which are sized to completely fill the row when installed within the corresponding tracks and means are provided as will hereinafter be described, to detachably connect the two cartridges together in end to end relationship when they are installed within the same track.

The individual cartridges whether of the standard or double size, consist of a pair of spaced and parallel end members 37, a longitudinally extending lower member 38 and a longitudinally extending upper member 39. Members 38 and 39 extend between adjacent ends of the end members 37. A plurality of vertical dividers 40 extend between the upper and lower members 38 and 39 in spaced relationship thus defining with the end members and the upper and lower members, equal rectangular openings 41.

The inner edges 37A of the end members, and the lower member 38 are substantially U-shaped in cross-sectional configuration and the dividers 40 are also provided with vertically extending grooves 40A giving an H-shaped cross-sectional configuration. It will be noted that a vertically extending aperture 40B is provided on one side of each of the dividers 40 which open into the vertical groove 40A. This joints to screws 40C to engage through the base flange of the lower member 39 and into the aperture 40B to attach the dividers to the lower member. The upper member 39 consists of a pair of spaced and parallel strips 38A defining slots 42 at least in the portion thereof between adjacent dividers 40. The upper ends of the dividers 40 engage between the strips 38A and are secured by rivets 38B or similar fastening means extending through the strips and the said upper ends. These slots 42 permit the entering and removal of rectangular plates 43 which are substantially rigid and are preferably formed from acrylic sheets although other materials may of course be used. The plates 43 may either be blank and completely opaque or may have characters or numerals such as indicated at 44 silk screened onto the acrylic with a transparent material with the remaining portion of the plate being rendered opaque. When entered into the cartridge vertically through the upper slots 42, the sides of the plates are received within the grooves 40A in the vertical dividers 40 and end members 37 and seat within the groove 38A within the lower member 38 with the upper edge of the plate being retained within the slots 42 in the upper member 39. It will therefore be appreciated that individual letters are easily changed or corrected as desired without the necessity of removing the remaining plates.

Blank plates of an opaque nature such as that illustrated by reference character 41A in FIG. 6, may be used to completely fill the frame which is then slid into the adjacent tracks as indicated by the arrows 45 in FIG. 6.

Situated within the casing between adjacent supports 28 and the upper and lower members 16 and 17 are longitudinally extending fluorescent lamps shown schematically by reference character 46A and supported upon supports 47 within the end walls 20 and 21. The necessary electrical equipment associated with such fluorescent lamps may also be incorporated but is not shown as this is conventional.

From the foregoing it will be appreciated that the entire front or rear of the enclosure is basically light proofed with the exception of the indicia 44 silk screened onto the panels 41 and which therefore stand out boldly and clearly when the fluorescent tubes or other illuminating means is operating. This is in contrast to conventional signs in which the entire facia of the sign is illuminated and the letters are opaque, it being understood that the present arrangement provides a sign which is clearly readable from a greater distance than conventional signage.

Once the cartridges are inserted in all of the tracks either blank or with indicia, gates collectively designated 46 are operated to close the ends of the tracks 18 and 18A to prevent the inadvertent removal of the cartridges or unauthorized access thereto. These gates are in the form of an angulated plate or strip 47 which, in the preferred embodiment, is hinged vertically as at 48 to the outer vertical wall 20 of the casing or enclosure and which extend from adjacent the upper walls 16 to adjacent the lower walls 17.

Two such gates are provided, one for the front tracks and one for the rear tracks and when closed take the position shown in the lower half of FIG. 6.

Pins 49 may be provided extending from the end wall 20 intermediate the two hinge lines 48 whereupon an angulated strip 50 which is centrally apertured may be engaged over the pin and which fits the angulations of the two gates as clearly shown in FIG. 6. A padlock 51 may then be engaged through an aperture in the outer end of pin 49 thus locking in all of the cartridges on the front and all of the cartridges on the rear of the casing with one lock thus making it relatively easy for authorized access to be obtained.

As mentioned previously, the construction and operation of either the standard sized cartridges or the double sized cartridges is the same.

However a further embodiment which is illustrated in FIG. 10 is designed for use specifically upon a wall structure shown schematically by reference character 52 and which may have restricted access. Even double sided signs may have restricted access under which circumstances the structures shown in FIG. 10 may be utilized.

The principal difference is the engagement and disengagement of the cartridges 36 with the tracks 18B and 28. The access of the cartridges is vertical with the gates 46 being situated on the upper frame member 16 and with the outer flange 53 acting as one side of the cartridge guide in conjunction with the flange 54 of the member 16. In this construction both end walls 19 and 20 are closed closing the ends of tracks 18B and 28 and access for installation and removal of the cartridges is as follows. Firstly the cartridges are made up with the necessary plates 41 bearing the necessary indicia and including blank opaque plates to fill out the entire length of the two cartridges. The double track 28 is then removed from the support 22 as hereinbefore described whereupon the lowermost cartridges specifically designated 36A are engaged within tracks 18B by the lower edges thereof and moved vertically downwardly in the end wall guides whereupon track 28 may be replaced. The upper cartridges specifically designated 36B are then engaged by the lower edges thereof within the end wall guides and moved downwardly into the upper portion of track 28 to the position shown in FIG. 10 whereupon the gates are closed to the position shown in phantom thus retaining the cartridges in position.

In the case of the double sided construction used in FIG. 10, a solid rectangular plate 55 may be engaged at the rear of the sign and retained by means of the rear gate specifically designated 46A whereupon a lock similar to that described in FIG. 6 may be utilized to hold the gates in the closed position.

FIGS. 9 and 10 also show the preferred construction of the hinges 48 although other such configurations may be used. A semi-cylindrical elongated bead 56 is formed on the inner edge of the gate 46 and this is engaged over a cylindrical bead 57 formed on the end wall 20 or upper wall 16 together with an accurately curved flange 58 spaced from the cylindrical bead 57. The semi-cylindrical bead engages the cylindrical bead 50 by sliding same in lengthways along the bead 57 with the ends 59 and 60 of the extrusion limiting the swinging movement of the gates in both directions, and in FIG. 10 it will be noted that the gate opens sufficiently to allow the distal edge 61 to clear the cartridge tracks.

Figure 11:
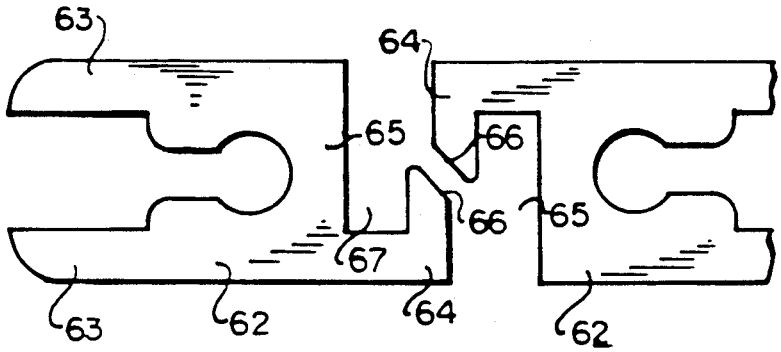
FIG. 11 is a top plan view of a cartridge joining strip with the second joining strip shown in fragmentary form.
Figure 12:
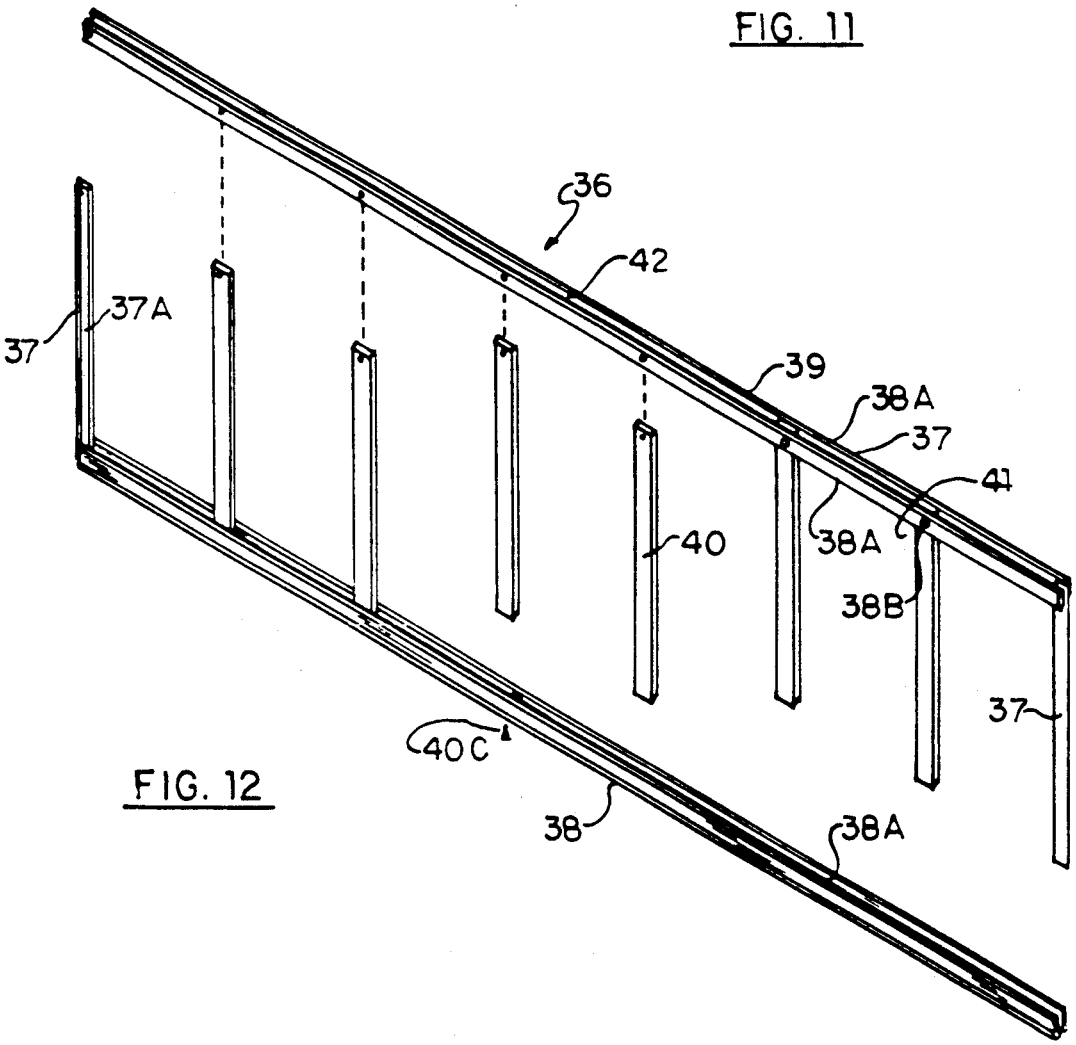
FIG. 12 is an isometric exploded view of one of the cartridges per se.
Figure 14:
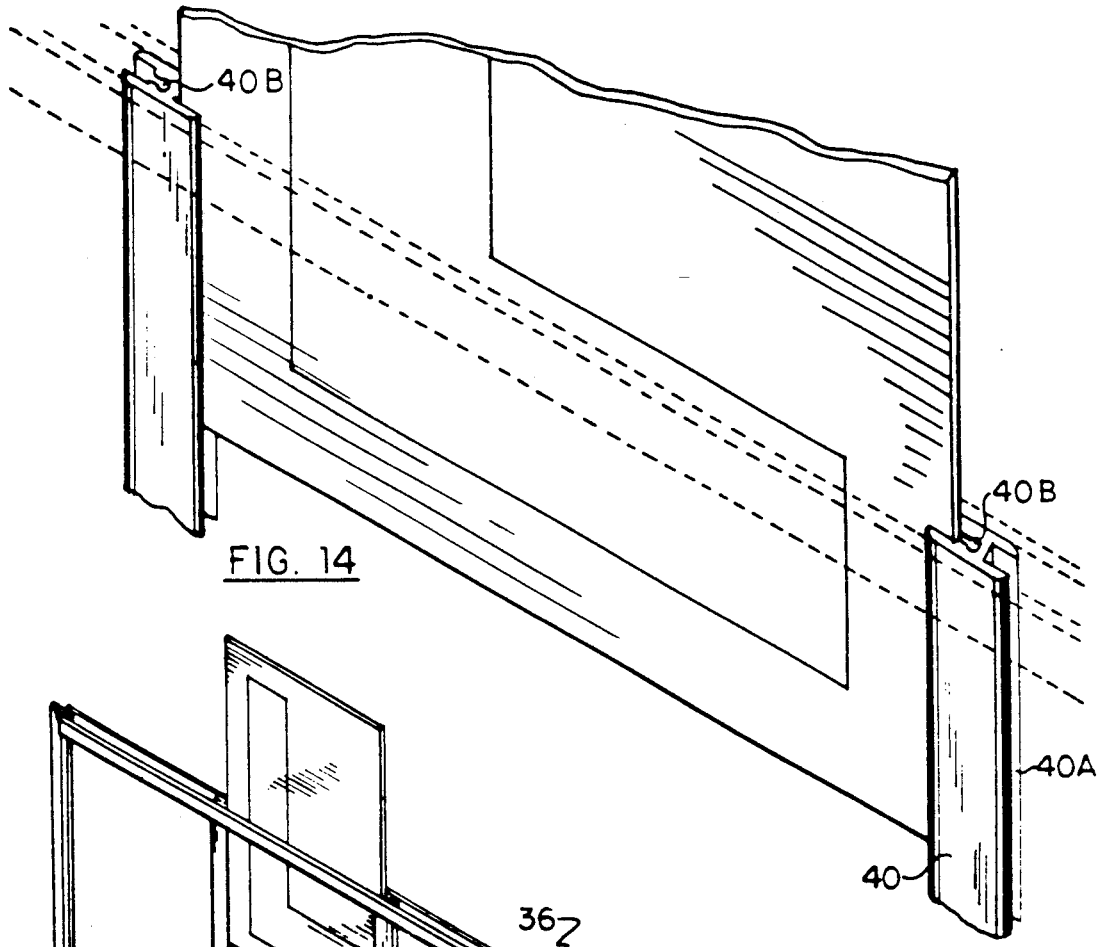
FIG. 14 is an enlarged fragmentary isometric view of the upper side portion of one of the cartridge frames.
Figure 13:
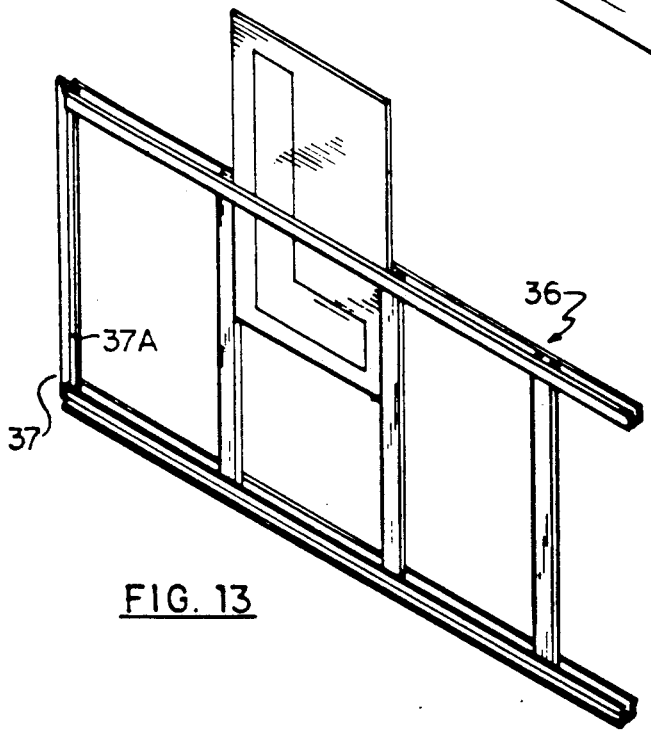
FIG. 13 is an isometric view of the assembled cartridge.
Figure 15:
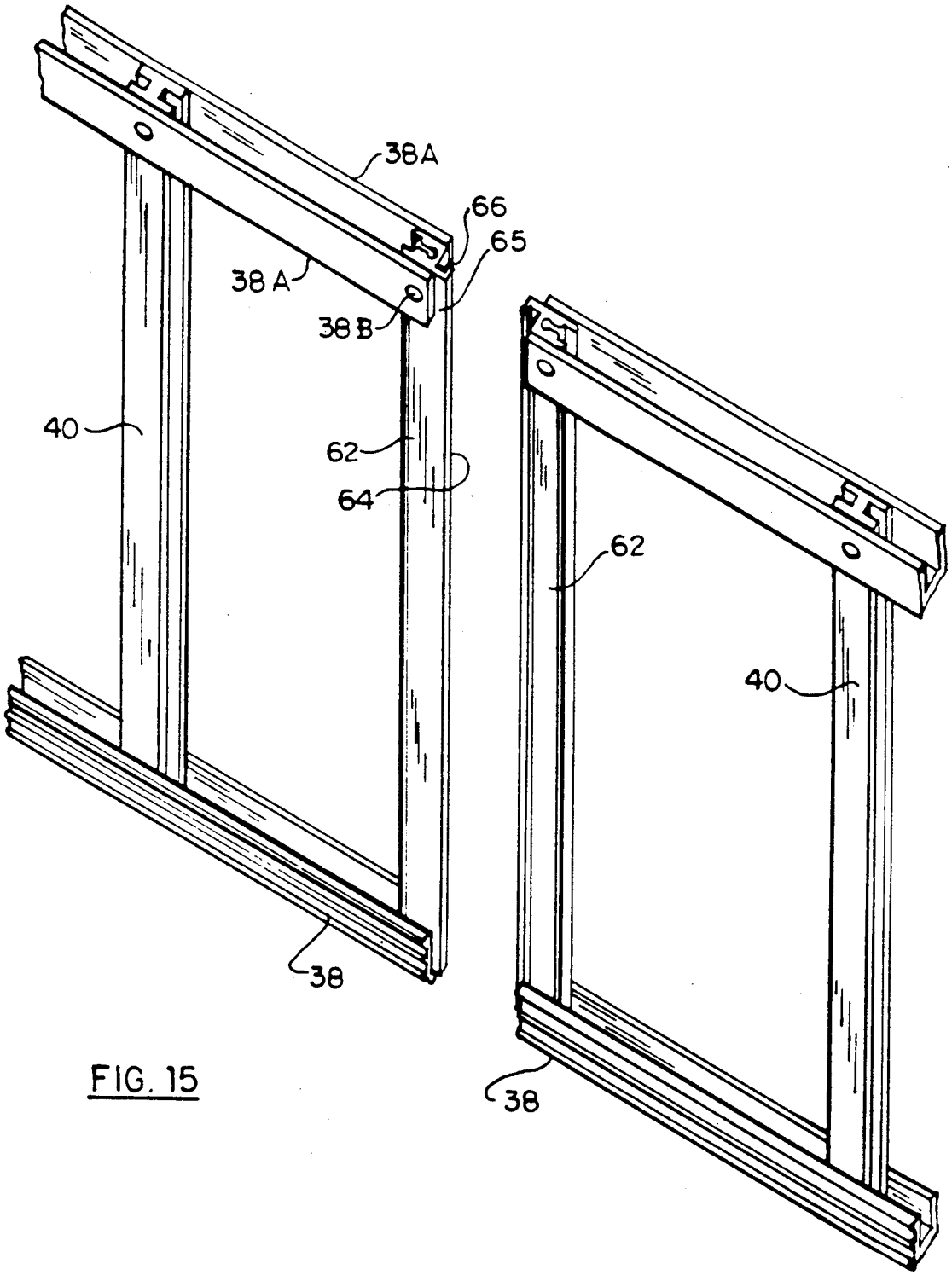
FIG. 15 is a fragmentary isometric view showing the junction between adjacent cartridges.

FIGS. 11 and 15 show an end joining strip for interconnection o adjacently situated cartridges. This joining strip 62 replaces the adjacent end members 37 of the cartridges. The inner vertical edges of these joining strips are U-shaped in cross-section to receive the edge of the plates 41 and include the vertical aperture 40B to receive screw 40C which secures the strip to the lower member 38. A rivet 38B secures the upper end of strip 62 between the strips 38A as clearly shown in FIG. 15. A hook element 64 extends from the outer edge 65 of the strip and includes an inclined camming surface 66. When the two cartridges are urged together within the common tracks, the ramp 66 of one cartridge slides up the other ramp 66 and snap engages into the recess 67 between the hooked end 64 and the end 65 thus holding the cartridges together and preventing inadvertent sideways movement of one or the other and also prevents any light from escaping through the junction between the two cartridges.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A sign assembly comprising in combination:

an enclosure including a pair of spaced and parallel end frame components, at least one pair of spaced and parallel cartridge guide and retaining track components extending between the said end components thereby defining a substantially rectangular open frame;

at least one elongated cartridge detachably engageable and removable from said cartridge guiding and retaining track components;

gate means in cooperation with said enclosure for detachably retaining said cartridges within said enclosure;

said cartridge being mounted between a pair of adjacent cartridge guiding and retaining track components, said gate means being situated vertically and selectively closing off one end of said cartridge guiding and retaining track components for selectively retaining said cartridge within said components and permitting removal of same from said cartridge guiding and retaining track components, and means closing off the other end of said cartridge guiding and retaining track components;

each said cartridge including a pair of spaced and parallel end frame members, a longitudinally extending lower frame member and a longitudinally extending upper frame member and a plurality of vertical divider members extending between said upper and lower frame members in equal spaced and parallel relationship with said end frame members, said frame members and said dividers defining a plurality of side by side rectangular plate receiving openings, elongated slots in said upper frame member at least through the portions thereof between said vertical dividers, track means in said side and lower frame members and in said dividers, and a plurality of plates slid ably engageable through said slots and into said track means, transparent indicia formed on at least some of said plates with the surrounding portions of said plates and the remainder of said plates being opaque;

a source of illumination within said assembly inboard of said cartridge guiding and retaining track components; and at least one longitudinally extending cartridge guiding and retaining support member extending between said frame components and a double sided cartridge guiding and retaining track component detachably securable to at least one side of said support member, said double sided cartridge guiding and retaining track component having guide means for said cartridges for support cartridges on the upper and lower longitudinally extending sides thereof, selective removal of said double sided cartridge guiding and retaining track components doubling the vertical distance between the now adjacent remaining cartridge guiding and retaining track components for the receipt of oversize cartridges substantially twice the height of standard cartridges.

2. The sign assembly according to claim 1 in which said gate means includes a panel member vertically hinged to said one end of said enclosure and extending from adjacent the upper side thereof to adjacent the lower side thereof.

3. The sign assembly according to claim 2 in which said support member is elongated and has an inverted T-shaped cross-sectional configuration including a vertically situated stem and a horizontally situated crossbar on the lower end thereof, a retaining channel formed along each side of the upper edge of said vertical stem, a leg engaging angle formed along each end of said crossbar, said double sided cartridge guiding and retaining track component including upper and lower longitudinally extending channels having an H-shaped cross-sectional configuration for receiving and retaining cartridges therein, a horizontally angulated flange extending inwardly from the upperside edge of the inner portion of said double channel and having a bead along the distal edge thereof hook engaging said retaining channel and an elongated leg flange extending inwardly and downwardly from the inner side of said double channel and engaging said leg engaging angle.

4. The sign assembly according to claim 1 wherein includes at least two cartridges between each pair of adjacent cartridge guiding and retaining track components, said cartridges extending the full length of said track components and means to detachably interlock said cartridges together in end to end relationship.

5. The sign assembly of claim 1 in which the gate means is rotatable about an axis parallel to the plane defined by said cartridge and perpendicular to the direction of movement of said cartridge within said cartridge guiding and retaining track components.

6. A sign assembly comprising in combination:

an enclosure including a pair of spaced and parallel end frame components, at least one pair of spaced and parallel cartridge guide and retaining track components extending between the said end components thereby defining a substantially rectangular open frame;

at least one elongated cartridge detachably engageable and removable from said cartridge guiding and retaining track components;

gate means in cooperation with said enclosure for detachably retaining said cartridges within said enclosure;

said cartridge being mounted between a pair of adjacent cartridge guiding and retaining track components, the uppermost of said cartridge guiding and retaining track components being slotted to receive said cartridge vertically, said gate means being situated horizontally across the upper side of the uppermost of said pair of cartridge guiding and retaining track components and selectively closing off one end of said cartridge guiding and retaining track components for selectively retaining said cartridge within said components and permitting removal of same from said cartridge guiding and retaining track components, and means closing off the other end of said cartridge guiding and retaining track components;

each said cartridge including a pair of spaced and parallel end frame members, a longitudinally extending lower frame member and a longitudinally extending upper frame member and a plurality of vertical divider members extending between said upper and lower frame members in equal spaced and parallel relationship with said end frame members, said frame members and said dividers defining a plurality of side by side rectangular plate receiving openings, elongated slots in said upper frame member at least through the portions thereof between said vertical dividers, track means in said side and lower frame members and in said dividers, and a plurality of plates slidably engageable through said slots and into said track means, transparent indicia formed on at least some of said plates with the surrounding portions of said plates and the remainder of said plates being opaque;

a source of illumination within said assembly inboard of said cartridge guiding and retaining track components; and at least one longitudinally extending cartridge guiding and retaining support member extending between said end frame components and a double sided cartridge guiding and retaining track component detachably securable to at least one side of said support member, said double sided cartridge guiding and retaining track component having guide means for said cartridges for support cartridges on the upper and lower longitudinally extending sides thereof, selective removal of said double sided cartridge guiding and retaining track components doubling the vertical distance between the now adjacent remaining cartridge guiding and retaining track components for the receipt of oversize cartridges substantially twice the height of standard cartridges.

7. The sign assembly according to claim 6 in which said support member is elongated and has an inverted T-shaped cross-sectional configuration including a vertically situated stem and a horizontally situated crossbar on the lower end thereof, a retaining channel formed along each side of the upper edge of said vertical stem, a leg engaging angle formed along each end of said crossbar, said double sided cartridge guiding and retaining track component including upper and lower longitudinally extending channels having an H-shaped cross-sectional configuration for receiving and retaining cartridges therein, a horizontally angulated flange extending inwardly from the upperside edge of the inner portion of said double channel and having a bead along the distal edge thereof hook engaging said retaining channel and an elongated leg flange extending inwardly and downwardly from the inner side of said double channel and engaging said leg engaging angle.

8. The sign assembly of claim 6 in which said gate means includes a front panel member vertically hinged to said one end of said enclosure and extending from adjacent the upper side thereof to adjacent the lower side thereof.

9. The sign assembly of claim 6 in which the gate means is rotatable about an axis parallel to the plane defined by said cartridge and perpendicular to the direction of movement of said cartridge within said cartridge guiding and retaining track components.

10. A sign assembly comprising in combination:

an enclosure including a surrounding casing the surrounding casing having front and rear sides, and front and rear cartridge guiding and retaining track components mounted on the front and rear sides of said surrounding casing;

cartridge guiding and retaining track components in said enclosure;

at least one elongated cartridge detachably engageable and removable from said cartridge guiding and retaining track components, and gate means in cooperation with said enclosure for detachably retaining said cartridges within said enclosure;

each said cartridge including a pair of spaced and parallel end frame members, a longitudinally extending lower frame member and a longitudinally extending upper frame member and a plurality of vertical divider members extending between said upper and lower frame members in equal spaced and parallel relationship with said end frame embers, said frame members and said dividers defining a plurality of side by side rectangular plate receiving openings, elongated slots in said upper frame member at least through the portions thereof between said vertical dividers, track means in said side and lower frame members and in said dividers, and a plurality of plates slidably engageable through said slots and into said track means, transparent indicia formed on at least some of said plates with the surrounding portions of said plates and the remainder of said plates being opaque;

a source of illumination within said assembly inboard of said cartridge guiding and retaining track components;

vertical cartridge guides on said end frame members;

at least one pair of spaced and parallel cartridge guide and retaining track components extending between the ends of said components one upon each side thereof thereby defining a substantially rectangular open frame on each side of said enclosure;

said cartridge mounting between a pair of adjacent track components on each side of said casing;

said gate means including front and rear gates being vertically situated and selectively closing off one end of said track components on the front and rear side of said casing, for selectively retaining said cartridges within said track components and permitting removal of said from said track components and means closing off the other ends of said track components;

at least one longitudinally extending cartridge guiding and retaining support member extending between said end frame components and a double sided cartridge guiding and retaining track component detachably securable to at least one side of said support member, said double sided cartridge guiding and retaining track component having guide means for said cartridges for support cartridges on the upper and lower longitudinally extending sides thereof, selective removal of said double sided cartridge guiding and retaining track components doubling the vertical distance between the now adjacent remaining cartridge guiding and retaining track components for the receipt of oversize cartridges substantially twice the height of standard cartridges.

11. The sign assembly of claim 10 which includes means to detachably lock said individual front and rear gates against unauthorized access.

* * * * *